US006813363B2

(12) United States Patent
Vonlanthen

(10) Patent No.: US 6,813,363 B2
(45) Date of Patent: Nov. 2, 2004

(54) PROCEDURE FOR SETTING A HEARING AID, AND HEARING AID

(75) Inventor: Andi Vonlanthen, Remetschwil (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 10/186,431

(22) Filed: Jul. 1, 2002

(65) Prior Publication Data

US 2002/0164042 A1 Nov. 7, 2002

Related U.S. Application Data

(63) Continuation of application No. 09/431,689, filed on Nov. 1, 1999.

(30) Foreign Application Priority Data

Oct. 14, 1999 (WO) ..... PCT/CH99/00486

(51) Int. Cl.[7] ..... H04R 25/00

(52) U.S. Cl. ..... 381/313; 381/85; 381/123; 381/356

(58) Field of Search ..... 381/60, 312, 313, 381/314, 315, 322, 323, 85–92, 123, 356

(56) References Cited

U.S. PATENT DOCUMENTS

| | | | | | |
|---|---|---|---|---|---|
| 3,875,349 | A | * | 4/1975 | Ruegg | 381/313 |
| 4,539,439 | A | * | 9/1985 | Strothmann et al. | 381/313 |
| 5,651,071 | A | | 7/1997 | Lindermann et al. | 381/314 |
| 5,754,661 | A | | 5/1998 | Weinfurtner | 381/312 |
| 6,115,478 | A | | 9/2000 | Schneider | 381/312 |
| 6,327,370 | B1 | * | 12/2001 | Killion et al. | 381/313 |

* cited by examiner

*Primary Examiner*—Suhan Ni
(74) *Attorney, Agent, or Firm*—Pearne & Gordon LLP

(57) ABSTRACT

An in-the-ear hearing aid having multiple directional microphones connected to a signal processing unit. The connection of the microphones can be reversed by a selector switch to selectively switch the hearing aid between a left-ear configuration and a right-ear configuration.

3 Claims, 1 Drawing Sheet

PROCEDURE FOR SETTING A HEARING AID, AND HEARING AID

BACKGROUND OF THE INVENTION

This invention relates to a procedure for adaptively setting a hearing aid and a hearing aid.

The configuration of the outer capsule of hearing aids, and especially of in-the-ear hearing aids, in many cases does not take into consideration whether the hearing aid concerned is to be worn in the left or in the right ear.

It is thus entirely possible to manufacture uniform hearing aids regardless of whether they are to be used on the left or the right ear.

However, if the hearing aid in question incorporates two or more microphones, for instance in order to establish for the hearing-aid signal processing unit a particular reception pattern relative to the direction of the impinging sound wave, these microphones must be placed on or in the ear in a specific position in relation to the head; for example, for frontally received audio signals a microphone must point forward, whether it is worn on the left or on the right ear.

It follows that for basically uniform hearing aids, it is necessary after all to produce and handle two variations, one for the left ear and one for the right ear. This requirement is illustrated in FIG. 1 which is a schematic top view of two in-the-ear hearing aids, one for the left ear L, the other for the right ear R. As can be seen, the microphone V which serves to process audio signals received from the front and the microphone H which processes audio signals received from behind are positioned in the otherwise uniform hearing aid in mirror-image fashion.

It goes without saying that the resulting need to produce hearing-aid sets with different microphone configurations, respectively for left-ear devices L and right-ear devices R as shown in FIG. 1, constitutes a significant drawback.

BRIEF SUMMARY OF THE INVENTION

The basic concept employed in the hearing aid involves directional switchability of the signal-processing microphones. Accordingly, only one hearing-aid configuration need be manufactured and, preferably, it is not until an individual is fitted with a hearing aid that the desired setting between the respective microphone of the signal processing unit and, ultimately, the integrated output converter of the hearing aid, is selected by means of the appropriate switch position.

DETAILED DESCRIPTION OF THE INVENTION

Figure 1:
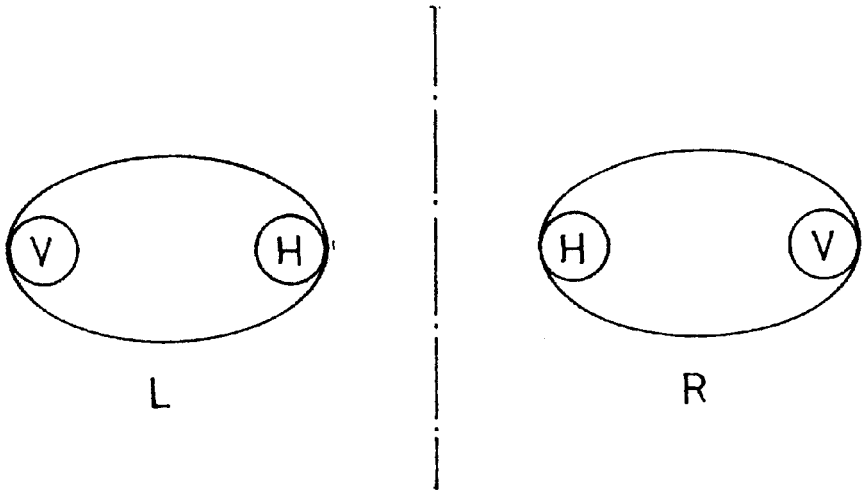
FIG. 1 is a schematic representation of a set of hearings aids having forward and rearward microphone according to the prior art.
Figure 2:
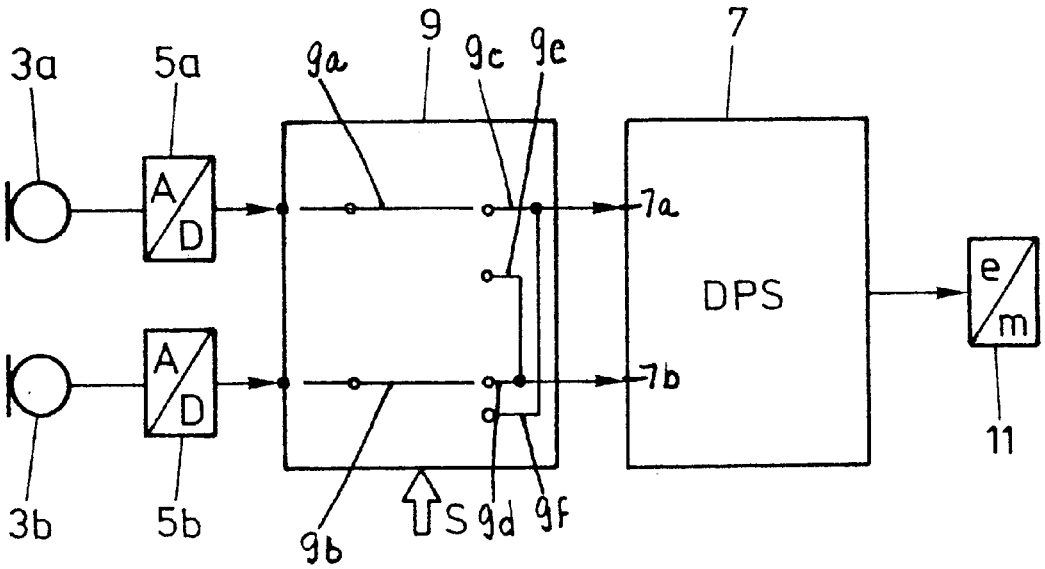
FIG. 2 is a schematic representation of a hearing aid according to the present invention.

FIG. 2 is a schematic illustration of an example of a manufacturable hearing aid 1 according to this invention and of the implementation of the adaptation procedure as provided for by this invention. As indicated in FIG. 2, the hearing aid 1 according to this invention incorporates at least two microphones 3*a* and 3*b* each of which connects to an analog/digital converter 5*a*, 5*b*. According to this invention, a selector switch assembly 9 with a control input S is interpositioned between the digital outputs of the analog/digital converters 5*a* and 5*b*, respectively, and the inputs of a signal processing unit 7. The switch assembly 9 permits reversal of the output of the microphones 3*a* and 3*b*, respectively, relative to the inputs of the signal processing unit 7 which in turn inverts the signal for the electromechanical output converter 11 of the hearing aid 1. This makes it possible to produce identical hearing aids, and especially in-the-ear type hearing aids, with the adaptation preferably performed when the hearing aid 1 is fitted, by setting the switch 9 so as to select forward or rearward reception of the microphone 3*a* or 3*b* and making the appropriate connection with the signal processing unit 7. The connection to the control input S of the switch assembly 9 may be hard-wired or wireless, depending on the technology employed in the design of the product.

Specifically, the selector switch assembly 9 is a double pole, double throw switch. The first microphone 3*a* is connected to a first throw 9*a* of the selector switch assembly 9 through the first analog/digital converter 5*a*. The second microphone 3*b* is connected to a second throw 9*b* of the selector switch assembly 9 through the second analog/digital converter 5*b*. A first pole 9*c*, 9*d* of each throw 9*a*, 9*b* is connected to a forward first signal input 7*a* of the signal processing unit 7. A second pole 9*e*, 9*f* of each throw 9*a*, 9*b* is connected to a rearward second signal input 7*b* of the signal processing unit 7.

Thus, when the selector switch assembly 9 is set in a first position mode, the first microphone 3*a* is operationally connected to the forward first input 7*a* of the signal processing unit 7 and the second microphone 3*b* is operationally connected to the rearward second input 7*b* of the signal processing unit 7. Thus set, the hearing aid 1 is configured for use in one ear, for example the left ear. Likewise, when the selector switch assembly 9 is set in a second position mode, the connections of the outputs of the microphones are reversed, as described above, such that the first microphone 3*a* is operationally connected to the rearward second input 7*b* of the signal processing unit 7 and the second microphone 3*b* is operationally connected to the forward first input 7*a* of the signal processing unit 7. Thus set, the hearing aid 1 is configured for use in the other ear, for example the right ear.

What is claimed is:

1. A method for the adaptive left-ear/right-ear setting of a hearing aid:

providing a hearing aid comprising a first microphone connected to a first input of a signal processing unit and a second microphone connected to a second input of the signal processing unit, the signal processing unit being operationally connected to at least one output converter of the hearing aid; and reversing by a selector switch the relative connections of the first microphone and the second microphone to the first and second inputs of the signal processing unit;

configuring the hearing aid to function in a left ear of a wearer by selectively connecting the first microphone to the first input and the second microphone to the second input; and configuring the hearing aid to function in a right ear of the wearer by selectively connecting the first microphone to the second input and the second microphone to the first input.

2. A hearing device comprising:

a first microphone;

a second microphone;

an output converter;

a first operational connection operationally connecting one of first and second microphones to said output converter;

a second operational connection operationally connecting one of first and second microphones to said output converter; and a controllable switching unit controllably switching said first microphone alternatively to one of said first operational connection and said second operational connection, and simultaneously switching said second microphone to said other one of said first operational connection and said second operational connection.

3. A hearing device comprising:

a first microphone;

a second microphone;

a first analog to digital converter being operationally connected to said first microphone for generating a first digital output;

a second analog to digital converter being operationally connected to said second microphone for generating a second digital output;

a signal processing unit having a first input terminal, a second input terminal and an output terminal;

an output converter connected to said output terminal;

a controllable switching unit controllably connecting said first digital output alternatively to one of said first input terminal and said second input terminal, and correspondingly connecting said second digital output to said other one of said first input terminal and said second input terminal.

* * * * *

UNITED STATES PATENT AND TRADEMARK OFFICE

CERTIFICATE OF CORRECTION

PATENT NO. : 6,813,363 B2
DATED : November 2, 2004
INVENTOR(S) : Andi Vonlanthen It is certified that error appears in the above-identified patent and that said Letters Patent is hereby corrected as shown below:

Title page,
Item [56], References Cited, FOREIGN PATENT DOCUMENTS, please insert the following documents:

| | | |
|---|---|---|
| -- JP | 62-125800 | 6/1987 |
| JP | 4-22243 | 1/1992 |
| DE | 11 25 759 A1 | 2/1996 -- |

Signed and Sealed this

Second Day of August, 2005

JON W. DUDAS
*Director of the United States Patent and Trademark Office*